United States Patent [19]

Aonuma et al.

[11] Patent Number: 4,965,162

[45] Date of Patent: Oct. 23, 1990

[54] ELECTROPHOTOGRAPHIC DEVELOPER CONTAINING TIN OXIDE

[75] Inventors: Shigeo Aonuma; Koichi Oyamada, both of Kanagawa, Japan

[73] Assignee: Fuji Xerox Co., Ltd., Tokyo, Japan

[21] Appl. No.: 403,080

[22] Filed: Sep. 5, 1989

Related U.S. Application Data

[63] Continuation of Ser. No. 80,287, Jul. 31, 1987, abandoned.

[30] Foreign Application Priority Data

Jul. 31, 1986 [JP] Japan ..... 61-0178703

[51] Int. Cl.[5] ..... G03G 9/08

[52] U.S. Cl. ..... 430/110; 525/934

[58] Field of Search ..... 430/110; 525/934

[56] References Cited

U.S. PATENT DOCUMENTS 4,347,298 8/1982 Kroll et al. ..... 430/110

4,514,485 4/1985 Ushiyama et al. ..... 430/107 X

*Primary Examiner*—J. David Welsh

*Attorney, Agent, or Firm*—Sughrue, Mion, Zinn, Macpeak & Seas

[57] ABSTRACT

An electrophotographic developer is disclosed, that contains toner particles and fine particles of tin oxide having an electrical resistivity of from $10^2$ to $10^9$ Ω.cm. The developer ensures efficient image transfer and exhibits good developing ability.

6 Claims, No Drawings

ELECTROPHOTOGRAPHIC DEVELOPER CONTAINING TIN OXIDE

This is a continuation of application Ser. No. 07/080,287, filed Jul. 31, 1987, now abandoned.

FIELD OF THE INVENTION

The present invention relates to an electrophotographic developer for use in rendering a latent electrostatic image visible. More particularly, the present invention relates to an electrophotographic developer that ensures efficient image transfer, is insensitive to environmental factors, and exhibits high durability.

BACKGROUND OF THE INVENTION

While electrophotography can be accomplished by a variety of methods such as those described in U.S. Pat. No. 2,297,691 and Japanese Patent Publication Nos. 23910/67 and 24748/68, the following steps are common to all of the methods currently employed: a latent electric image is formed on a photoreceptor containing a photo-conductive material by various techniques; the latent image is rendered visible with a toner; the toner image is transferred onto a receiving sheet, such as paper, as required; and the transferred image is fixed by suitable means such as heating or application of a solvent vapor so as to obtain a hard copy.

The electric latent image can be made visible with a toner by various techniques such as the magnetic brush method described in U.S. Pat. No. 2,874,063, the cascade development method described in U.S. Pat. No. 2,618,552 and the powder cloud method described in U.S. Pat. No. 2,221,776.

Developers used for this purpose are generally composed of a toner and a carrier in admixture. The toner is prepared by blending in a molten state a resin (e.g., polystyrene, a styrene-butadiene copolymer, and a polyester) with a pigment (e.g., carbon black and phthalocyanine Blue) or a dye being used as colorants, and then grinding the cooled mix into particles ranging from 1 to 30 μm in size. The carrier is in the form of glass beads or particles of metals such as iron, nickel and ferrite having an average size either comparable to that of the toner particles or up to 500 μm, or in the form of such beads or metallic particles provided with coatings of various resins.

Irrespective of the method of development used in practice, actual development is accomplished by the toner which separates from the developer. Since the toner is a component that is directly involved in development, the efficiency with which the electrostatic image on the photoreceptor is visualized and the efficiency with which the developed image is transferred onto a receiving sheet such as paper are of extreme importance for the toner. Other requirements that should be met by the developer are that it produce a uniform charge pattern, that the image quality obtained using the developer is insensitive to environmental factors, and that the developer have high durability. One practice that has often been employed with a view to satisfying these needs is to incorporate a charge controller in the developer as an additive.

However, the conventionally used charge controllers are not completely satisfactory in their ability to meet the aforementioned requirements and they have often failed to attain the desired results.

SUMMARY OF THE INVENTION

The present inventors conducted extensive studies in order to produce an electrophotographic developer that possesses all of the properties that are required in the prior art.

An object, therefore, of the present invention is to provide an electrophotographic developer that ensures improved efficiency of image transfer.

Another object of the present invention is to provide an electrophotographic developer that has good developing ability, in particular, a high capability to ensure consistent triboelectrification as manifested by the generation of a sharp distribution of electric charges.

Still another object of the present invention is to provide an electrophotographic developer that is insensitive to environmental factors in terms of the quantity of charges generated and the quality of image produced.

A further object of the present invention is to provide a highly durable electrophotographic developer that can be used to produce a great number of copies without experiencing any image deterioration or fogging.

A still further object of the present invention is to provide an electrophotographic developer which, when a color toner is used, satisfies all of the aforementioned requirements without sacrificing the reproduction of desired colors.

As a result of intensive studies conducted in order to attain these objects, the present inventors have now found that the defects of the conventional product can be entirely eliminated by mixing toner particles with fine particles of tin oxide. The present invention has been accomplished on the basis of this finding.

The electrophotographic developer of the present invention is characterized by containing toner particles and fine particles of tin oxide having an electrical resistivity of from $10^2$ to $10^9$ Ω·cm.

DETAILED DESCRIPTION OF THE INVENTION

The fine particles of tin oxide used as one component of the electrophotographic developer of the present invention consist essentially of $SnO_2$ or a mixture of $SnO_2$ and SnO. These fine particles of tin oxide have an electrical resistivity of from $10^2$ to $10^9$ Ω·cm, preferably in the range of from $10^5$ to $10^8$ Ω·cm. If the fine particles of tin oxide have an electrical resistivity of less than $10^2$ Ω·cm, the resulting developer has a decreased resistivity and various disadvantages will result such as reduced triboelectric effects, lower efficiency of image transfer, lower image density and increased fogging. If, on the other hand, the electrical resistivity of the fine particles of tin oxide is higher than $10^9$ Ω·cm, the chance of the occurrence of edge effects is increased and at the same time, various disadvantages will also result such as excessive triboelectric effects, lower image density and reduced efficiency of image transfer.

The fine particles of tin oxide preferably have an average size of not more than 0.3 μm. In order to attain good results, these particles are preferably incorporated in an amount of from 0.1 to 5.0 parts by weight, more preferably from 1.0 to 3.0 parts by weight, per 100 parts by weight of the toner particles.

The electrical resistivity of the fine particles of tin oxide used in the present invention is measured with a simplified specific resistance meter consisting of a Teflon cell (diameter: 5.5 cm), a press ram (diameter: 4.2 cm; surface area: 13.85 $cm^2$), and a hand press on which is exerted a hydraulic pressure of 35.5 $kg/cm^2$ (producing a pressure of 100 $kg/cm^2$ on the specimen).

The average size of the fine particles of tin oxide is measured by the centrifugal precipitation method as described below. That is, the fine particles are mixed with a diluted aqueous ammonia for 10 to 15 hours. The resulting dispersion is charged in centrifuge tubes and subjected to centrifugation with various centrifugal conditions changing centrifugal force and duration. Then, the non-precipitated portion of the dispersion in the centrifuge tube under each centrifugal condition is evaporated to dryness and is weighed. On the other hand, classification points corresponding to the respective centrifugal conditions (sizes of particles which can be separated (precipitated) under the respective centrifugal conditions) has been measured in advance. The average size of the fine particles is calculated from the classification points and the weight of solid in the non-precipitated portion of the dispersion.

The tone particles to be mixed with the fine particles of tin oxide to prepare the developer of the present invention may be selected from known products having a colorant dispersed in a binder resin. The binder resin to be used may be selected from homo- and copolymers of monomers such as styrenes (e.g., styrene, chlorostyrene, and vinylstyrene), monoolefins (e.g., ethylene, propylene, butylene, and isoprene), vinyl esters (e.g., vinyl acetate, vinyl propionate, vinyl benzoate, and vinyl acetate), esters of a-methylenealiphatic monocarboxylic acids (e.g., methyl acrylate, ethyl acrylate, butyl acrylate, dodecyl acrylate, octyl acrylate, phenyl acrylate, methyl methacrylate, ethyl methacrylate, butyl methacrylate, and dodecyl metharylate), vinyl ethers (e.g., vinyl methyl ether, vinyl ethyl ether, and vinyl butyl ether), and vinyl ketones (e.g., vinyl methyl ketone, vinyl hexyl ketone, and vinyl isopropenyl ketone). Typical binder resins include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene, and polypropylene.

Other useful binder resins include polyesters, polyurethanes, epoxy resins, silicone resins, polyamides, modified rosin, paraffins, and waxes.

Typical toner colorants include carbon black, Nigrosine dyes, aniline blue, Chalocoil Blue, Chrome Yellow, Ultramarine Blue, DuPont Oil Red, quinoline yellow, methylene blue chloride, phthalocyanine Blue, Malachite green oxalate, lamp black, and Rose Bengal.

It should be noted that the binder resin and colorant that can be used in the present invention are by no means limited to those listed above.

The toner particles used in the present invention preferably have average sizes not exceeding about 30 μm, more preferably in the range of from 3 to 20 μm, measured according to Coulter counter method (according to PRODUCT REFERENCE MANUAL of Coulter counter Model TA-II type produced by Coulter Electronics Inc.).

The developer of the present invention containing the fine particles of tin oxide described above may be used as a one-component developer (including no carrier) or as a so-called two-component developer having both a carrier and a toner in combination. The latter is prepared by first mixing the fine particles of tin oxide and toner particles, then mixing with a carrier. The mixing ratio (by weight) of the toner particles to the carrier is generally from 1/5 to 15/1 and preferably from 1/2 to 6/1.

The carrier is composed of particles having an average size of up to 500 μm (measured according to Coulter counter method) and various materials are known to be suitable as carriers, such as particles of iron, nickel, cobalt, iron oxides, ferrite, glass beads, and particulate silicone. The surfaces of these particles may be coated with layers of suitable materials such as fluorine-containing resins, acrylic resins, and silicone resins.

The developer of the present invention is suitable for the purpose of developing an electrostatic latent image formed on a photoreceptor or an electrostatic recording material. More specifically, an electrostatic latent image is formed electrophotographically on a photoreceptor comprising either an inorganic photoconductive material such as selenium, zinc oxide, cadmium oxide or amorphous silicon, or an organic photoconductive material such as a phthalocyanine or bisazo pigment; alternatively, an electrostatic latent image is formed, by means of stylus electrodes, on an electrostatic recording material comprising a dielectric material such as polyethylene terephthalate. The electrostatic latent image thus formed is subjected to development by a suitable method such as the magnetic brush method or the cascade method, in which the particles of the developer of the present invention are deposited on the latent image so as to form a toner image; the toner image is transferred onto a receiving sheet such as paper and fixed to produce a final copy. The surface of the photoreceptor or the electrostatic recording material is cleaned of any residual toner particles by an appropriate method such as blade cleaning, brush cleaning, web cleaning or roll cleaning.

The present invention is hereinafter described in greater detail with reference to the following examples, to which the scope of the present invention is by no means limited.

EXAMPLE 1

| Components | Parts by weight |
|---|---|
| Styrene/n-butyl methacrylate copolymer | 89 |
| Dimethylquinacridone red pigment | 1 |
| Copper phthalocyanine blue pigment | 10 |

These components were mixed in a molten state, and after cooling, the mix was ground into fine particles which were classified to obtain blue toner particles having an average particle size of 11.0 μm.

Tin tetrachloride ($SnCl_4$) was dissolved in water and precipitated to make fine particles of $SnO_2$ or a mixture of $SnO_2$ and SnO having an average size of 0.2 μm. No metallic tin was detected in these fine particles by X-ray analysis, and they had an electrical resistivity of $4.1 \times 10^7$ Ω·cm. One hundred parts by weight of the blue toner particles, 1.0 part by weight of the fine tin oxide particles, 0.5 part by weight of a polyvinylidene fluoride powder, and 0.5 part by weight of a colloidal silica powder were blended in a Henschel mixer to form a toner.

EXAMPLE 2

A toner was prepared as in Example 1 except that the styrene/n-butyl methacrylate copolymer used in the blue toner composition was replaced by a mixture consisting of 62 parts by weight of a graft copolymer of a propylene copolymer and a styrene/n-butyl methacrylate copolymer (weight ratio of the copolymers in the graft copolymer: 95/5) and 27 parts by weight of a crosslinked styrene/n-butyl methacrylate copolymer.

EXAMPLE 3

A toner was prepared as in Example 1 except that the dimethylquinacridone red pigment and the copper phthalocyanine blue pigment used in the blue toner composition were replaced by 11 parts by weight of carbon black.

COMPARATIVE EXAMPLE 1

A toner was prepared as in Example 2 except that neither $SnO_2$ particles nor $SnO_2/SnO$ particles were used.

COMPARATIVE EXAMPLE 2

A toner was prepared as in Example 3 except that neither $SnO_2$ nor $SnO_2/SnO$ particles were used.

COMPARATIVE TEST

A carrier consisting of ferrite cores (average size: 130 μm) having coatings of a styrene/n-butyl methacrylate copolymer was mixed with each of the toners prepared in Examples 1 to 3 and in Comparative Examples 1 and 2 at the toner concentration (=(toner/(toner+carrier))×100) of 3.0 wt %. The resulting five samples of developer were set in a copier (Model 3870 of Fuji Xerox Co., Ltd.) and subjected to a continuous copying test for $1.5\times10^4$ runs. The test results are shown in Table 1.

TABLE 1

| Developer sample | Durability test: Initial, Charged amount (μc/g) | Durability test: Initial, Charge distribution (mm) | Durability test: After 15,000 runs, Charged amount (μc/g) | Durability test: After 15,000 runs, Charge distribution (mm) | Environmental test (Charged amount): 20° C. 50% RH (μc/g) | Environmental test (Charged amount): 30° C. 80% RH (μc/g) | Environmental test (Charged amount): 10° C. 30% RH (μc/g) | Transfer efficiency (%) | Color |
|---|---|---|---|---|---|---|---|---|---|
| Example 1 | 22.5 | 5.5~8.5 | 21.8 | 5.0~9.5 | 22.5 | 19.3 | 20.9 | 83 | no difference from Comparative Example 1 |
| Example 2 | 20.0 | 5.0~8.0 | 20.5 | 5.0~9.0 | 20.0 | 17.0 | 21.1 | 84 | no difference from Comparative Example 1 |
| Example 3 | 18.4 | 3.0~6.0 | 18.1 | 2.5~6.5 | 18.4 | 17.5 | 20.3 | 87 | no difference from Comparative Example 2 |
| Comparative Example 1 | 30.3 | 5.5~18.0 | 19.9 | −1.0~11.0 | 30.3 | 16.0 | 25.8 | 72 | — |
| Comparative Example 2 | 26.3 | 3.0~7.0 | 16.7 | 0~8.0 | 26.3 | 14.7 | 28.4 | 80 | — |

[Note]

The charged amount was measured according to the method described in Japanese Patent Application (OPI) No. 79958/82, wherein the toner particles triboelectrically charged by mixing with the carrier was blown off to pass through a parallel electrical field in a vertical direction to the electrical field, and the throw-distance of the toner which varies depending on the charge amount of the toner particles due to the electrical field was measured, from which an average charged amount of the toner particles was calculated.

The charge distribution was measured with the charge spectrograph as described on page 85 of *Electrophotography—The Society Journal,* The Society of Electrophotography of Japan, Vol. 22, No. 1 (1983), which was expressed in terms of the throw-distances (mm) of the toner particle having the lowest charged amount (which may have an opposite polarity) and the toner particle having the highest charged amount.

The transfer efficiency was measured in terms of the ratio of the density of a toner image on the photoreceptor before transfer to that of the transferred toner image by adhering them on adhesive tapes and measuring their densities using a densitometer, Macbeth RD-517 produced by Macbeth Co., with reference to a gray scale produced by Eastman Kodak Co.

EXAMPLE 4

| Components | Parts by weight |
|---|---|
| Graft copolymer of propylene polymer and styrene/n-butyl methacrylate copolymer (weight ratio of the copolymers: 95/5) | 56 |
| Crosslinked styrene/n-butyl methacrylate copolymer | 36 |
| Copper phthalocyanine blue pigment | 7 |
| Dimethylquinacridone red pigment | 1 |

These components were mixed in a molten state, and after cooling, the mix was ground into fine particles which were classified to obtain a blue toner particles having an average particle size of 11.0 μm.

Tin tetrachloride ($SnCl_4$) was dissolved in water and precipitated to make fine particles of $SnO_2$ or a mixture of $SnO_2$ and SnO having an average size of 0.2 μm. No metallic tin was detected in these fine particles by X-ray analysis, and they had an electrical resistivity of $4.1\times10^7$ Ω·cm. A hundred parts by weight of the blue toner particles, 2.0 parts by weight of the fine tin oxide particles, 0.5 part by weight of a polyvinylidene fluoride powder, and 0.5 part by weight of a colloidal silica powder were blended in a Henschel mixer to form a blue toner.

EXAMPLE 5

| Components | Parts by weight |
|---|---|
| Graft copolymer of propylene polymer and styrene/n-butyl methacrylate copolymer (weight ratio of the copolymers: 95/5) | 53 |
| Crosslinked styrene/n-butyl methacrylate copolymer | 35 |
| Copper phthalocyanine blue pigment | 1 |
| Dimethylquinacridone red pigment | 5 |

-continued

| EXAMPLE 5 | |
|---|---|
| Components | Parts by weight |
| Disazo yellow pigment | 6 |

Starting with these components, a brown toner was prepared by repeating the procedures of Example 4.

COMPARATIVE EXAMPLE 3

A blue toner was prepared as in Example 4 except that the $SnO_2$ or $SnO_2/SnO$ particles were replaced by carbon black (Regal 330R).

COMPARATIVE EXAMPLE 4

A blue toner was prepared as in Example 4 except that neither $SnO_2$ nor $SnO_2/SnO$ particles were used.

COMPARATIVE EXAMPLE 5

A brown toner was prepared as in Example 5 except that neither $SnO_2$ nor $SnO_2/SnO$ particles were used.

COMPARATIVE TEST

A carrier consisting of ferrite cores (average size: 130 μm) having coatings of a styrene/n-butyl methacrylate copolymers was mixed with each of the toners prepared in Examples 4 and 5 and in Comparative Examples 3 to 5 at the toner concentration of 3.0 wt %. The resulting five samples of developer were set in a copier (Model 3870 of Fuji Xerox Co., Ltd.) and subjected to a continuous copying test for $1.5\times10^4$ runs. The test results are show in Table 2.

TABLE 2

| | Durability test | | | | | | | | |
|---|---|---|---|---|---|---|---|---|---|
| | Initial | | After 15,000 runs | | Environmental test (Charged amount) | | | Transfer | |
| Developer sample | Charged amount (μc/g) | Charge distribution (mm) | Charged amount (μc/g) | Charge distribution (mm) | 20° C. 50% RH (μc/g) | 30° C. 80% RH (μc/g) | 10° C. 30% RH (μc/g) | efficiency (%) | Color |
| Example 4 | 20.0 | 5.0~8.0 | 20.5 | 5.0~9.0 | 20.0 | 17.0 | 21.1 | 84 | no difference from Comparative Example 4 |
| Example 5 | 19.3 | 4.0~7.0 | 18.5 | 3.0~7.0 | 19.5 | 18.6 | 20.6 | 85 | no difference form Comparative Example 5 |
| Comparative Example 3 | 25.0 | 5.0~9.0 | * | * | * | * | * | * | inferior to Comparative Example 4 |
| Comparative Example 4 | 30.3 | 5.5~18.0 | 19.9 | −1.0~11.0 | 30.3 | 16.0 | 25.8 | 72 | — |
| Comparative Example 5 | 35.0 | more than 20 | * | * | 35.0 | 18.4 | 29.7 | 74 | — |

*not measured

The data in Tables 1 and 2 clearly shows the superiority of the present invention. The electrophotographic developer of the present invention contains fine particles of tin oxide having an electrical resistivity of from $10^2$ to $10^9$ Ω·cm. As will be clear from the comparison between the results of Examples 1 to 5 and those of Comparative Examples 1 to 5, the developer of the present invention has improved image transfer efficiency and exhibits good developing ability, in particular consistent triboelectrification that leads to the generation of a sharp charge pattern. The developer is also insensitive to environmental factors in terms of the quantity of charges generated and the quality of image attainable. Furthermore, the developer is highly durable and can be used for producing a great number of copies without experiencing any image deterioration or fogging. As a further advantage, the developer permits the use of a color toner without sacrificing color reproduction.

While the invention has been described in detail and with reference to specific embodiments thereof, it will be apparent to one skilled in the art that various changes and modifications can be made therein without departing from the spirit and scope thereof.

What is claimed is:

1. An electrophotographic developer containing toner particles comprising a binder resin and a colorant, and tin oxide fine particles composed substantially of $SnO_2$ or a mixture of $SnO_2$ and SnO, said fine particles having an electrical resistivity of from $10^5$ to $10^8$ Ω·cm measured when applying thereto a pressure of 100 kg $cm^2$.

2. An electrophotographic developer according to claim 1, wherein said colorant is a chromatic colorant.

3. An electrophotographic developer according to claim 1, wherein said fine particles have an average size of not more than 0.3 μm.

4. An electrophotographic developer according to claim 1, wherein said fine particles are incorporated in an amount of from 0.1 to 5.0 parts by weight per 100 parts by weight of toner particles.

5. An electrophotographic developer according to claim 1, wherein said fine particles of tin oxide have an electrical resistivity of from $10^5$ to $10^9$ Ω·cm at 100 kg/cm.

6. A process for developing an electrostatic latent image formed electrophotographically on a photoreceptor comprising a photoconductive material comprising subjecting said latent image bearing electrophotographic photoreceptor with an electrophotographic developer containing toner particles and fine particles of tin oxide having an electrical resistivity of from $10^2$ to $10^9$ Ω·cm.

* * * * *